US005467685A

United States Patent [19]

Hubl

[11] Patent Number: 5,467,685

[45] Date of Patent: Nov. 21, 1995

[54] RODLESS PNEUMATIC CYLINDER HAVING A PAIR OF DRIVEN ELEMENTS

[75] Inventor: Werner Hubl, Xanten, Germany

[73] Assignee: Norgren Martonair GmbH, Alpen/Niederrhein, Germany

[21] Appl. No.: 320,656

[22] Filed: Oct. 11, 1994

[30] Foreign Application Priority Data

Oct. 12, 1993 [DE] Germany ..... 43 34 681.2

[51] Int. Cl.[6] ..... F01B 29/00

[52] U.S. Cl. ..... 92/88; 92/137; 92/13.7; 92/20

[58] Field of Search ..... 92/88, 137, 13.7, 92/20

[56] References Cited

U.S. PATENT DOCUMENTS

| | | | |
|---|---|---|---|
| 2,097,561 | 11/1937 | Curtis | 92/137 |
| 3,820,446 | 6/1974 | Granbom et al. . | |
| 4,656,881 | 4/1987 | Goedecke et al. | 92/137 |
| 4,664,020 | 5/1987 | Kaiser . | |
| 4,813,341 | 3/1989 | Vaughn | 92/88 |
| 5,178,056 | 1/1993 | Mai . | |
| 5,195,391 | 3/1993 | Barbat et al. | 92/88 |
| 5,303,638 | 4/1994 | Green | 92/137 |
| 5,347,914 | 9/1994 | Kinoshita et al. | 92/137 |

FOREIGN PATENT DOCUMENTS

| | | | |
|---|---|---|---|
| 0475032 | 3/1992 | European Pat. Off. . | |
| 3016696 | 11/1981 | Germany | 92/137 |
| 4024717 | 2/1992 | Germany . | |
| 4027636 | 4/1992 | Germany . | |
| 0204303 | 12/1982 | Japan | 92/137 |

*Primary Examiner*—Thomas E. Denion
*Attorney, Agent, or Firm*—Cushman Darby & Cushman

[57] ABSTRACT

A linear actuator, adapted especially for picking up and transporting workpieces, comprises a pneumatic, rodless cylinder having a pair of driven elements mounted on opposite sides of its body. The first driven element is directly connected to the piston of the cylinder via a sealed, longitudinal slot formed in the cylinder body and the second driven element is drivably connected to the piston or first driven element by a flexible drive band that passes around rollers mounted at opposite ends of the cylinder body. The driven elements therefore move linearly in opposite directions to one other upon actuation of the rodless cylinder. The second driven element may be fixedly secured to a stationary structure so that, upon actuation of the cylinder, the cylinder body itself and the first element will simultaneously execute linear motion in the same direction whereby the first element, which may have a work piece—gripping device mounted on it, will in effect execute double its normal stroke length.

15 Claims, 4 Drawing Sheets

RODLESS PNEUMATIC CYLINDER HAVING A PAIR OF DRIVEN ELEMENTS

This invention relates to fluid-powered linear actuators, especially but not exclusively to pneumatic linear actuators.

More particularly, the present invention proposes a linear actuator that is relatively compact and of relatively simple design but that has a versatile application to, for example, the picking up, transporting and/or positioning of workpieces in manufacturing operations.

According to the present invention, there is provided a fluid-powered linear actuator comprising:

a) a fluid-powered rodless cylinder including an elongate body and a piston reciprocably movable within a bore in said body upon the application of fluid pressure alternately to opposite ends of the piston; p1 b) a first element mounted externally of the body on or adjacent to one side thereof and reciprocably drivable by, and in the same direction as, the piston longitudinally of the body;

c) a second element mounted externally of the body on or adjacent to a side thereof opposite to said first side and reciprocably movable longitudinally of the body; and d) flexible drive means connected to the first element or the piston and to the second element, the flexible drive means extending longitudinally of the body and around bearing means located at opposite ends of the body, whereby movement of the piston in response to the application of fluid pressure thereto causes the second element simultaneously to move longitudinally of the body in a direction opposite to the direction of movement of the piston and the first element.

The rodless cylinder may be of any known type. For example, it may be of the so-called band or cable type or of the type having a magnetic coupling between the piston and the driven, actuating element. In a preferred embodiment of the invention, however, the rodless cylinder is pneumatically operated and is of the slotted body type, an example of which is described in European Patents Nos 0068088 and 0069119 which relate to our LINTRA rodless cylinders (LINTRA is a trade mark). Here, and in an actuator of the present invention, the driven ('first') element preferably partially surrounds the cylinder body, symmetrically bridging the slot in the cylinder body. Likewise, the second element preferably partially surrounds the cylinder body.

Regardless of the type of cylinder, however, it is advantageous that the cylinder body has bearing surfaces formed on its external surface for the first element and/or for the second element. These surfaces serve the purpose of limiting lateral movement of the first and/or second elements relative to the cylinder body. However, additional or alternative bearing means spaced from the external surface of the cylinder body may be provided for that purpose.

The second element of an actuator of the invention may, like the first element, move in use relative to the cylinder body, which may be spatially fixed to a stationary structure, for example part of a machine. In that case, the actuator will impart to the first and second elements two synchronised linear movements of opposite direction.

Alternatively, the second element may be fixedly secured to a structure, for example part of a machine, whereby, in use, movement of the rodless cylinder's piston upon the application of fluid pressure thereto will cause the cylinder body to move linearly relative to the second element and the structure in the same direction as the direction of movement of piston and the first element. In effect, this means that the first element will move from one position to another at double the speed of its movement if the cylinder body were stationary. At the same time the stroke of the first element is doubled. In such an arrangement, the second element may be mounted in any orientation requisite to the application in question. Vertical mounting of the cylinder body, however, has the advantage that the second element will be subjected to relatively low stresses even if the actuator is handling heavy loads. Also in such an arrangement, it is advantageous to feed and exhaust the actuating fluid to and from the cylinder chambers on each side of the piston via interconnected passageways formed in the second element and the cylinder body rather than, as is more conventional, via the opposite ends of the cylinder body.

The flexible drive means, which, in effect, is endless, may comprise, for example, a belt which may be toothed, a cable or a chain and the bearings, about which it passes, located at opposed ends of the cylinder body would be selected accordingly, for example rollers, pulleys or sprocket wheels.

The first and/or second elements may have mounted thereon a further actuator or other unit that requires the supply of, eg, compressed air, electrical power or cooling liquids or other media to it. This can be attained quite simply in an actuator of the invention where the flexible drive means is in the form of a band or belt. Thus, the band or belt may be formed internally with fluid- or cable-carrying conduits that communicate with appropriate ports formed in the first and/or second elements. In the case where electrical energy is required, the band or belt may alternatively have electrical cables fixed upon its surface.

The further actuator may, for example, be a conventional fluid-powered cylinder having a piston rod providing an additional stroke in the same direction as the movement of the first or second element, as the case may be, on which such further actuator is mounted.

Further, an elongate actuator may, for example, be pivotally mounted on the first or second element. Preferably, such an actuator will be supported on the flexible drive means at a point spaced from the first or second element, as the case may be, on which it is mounted. Then, as the supporting area of the flexible drive means moves around the bearing located at the end of the cylinder body during a linear movement of the first or second element, the additional actuator will perform a rotary movement laterally to the axis of the cylinder body. This linear/lateral movement can be used eg to pick up a part with a gripper mounted on the additional actuator, to lift the part and after that to move it in a linear manner.

As in conventional fluid-powered cylinders, an actuator of the invention may easily be provided with stroke limiting means by, for example, providing stops on the cylinder body and braking means may be associated with one or both bearings about which the flexible drive means passes and/or with the first or second elements. Likewise, an actuator of the invention may include position sensors and/or other accessories commonly employed in conventional fluid-powered actuators.

Embodiments of the invention will now be described by way of example only with reference to the accompanying drawings in which.

Figure 1:
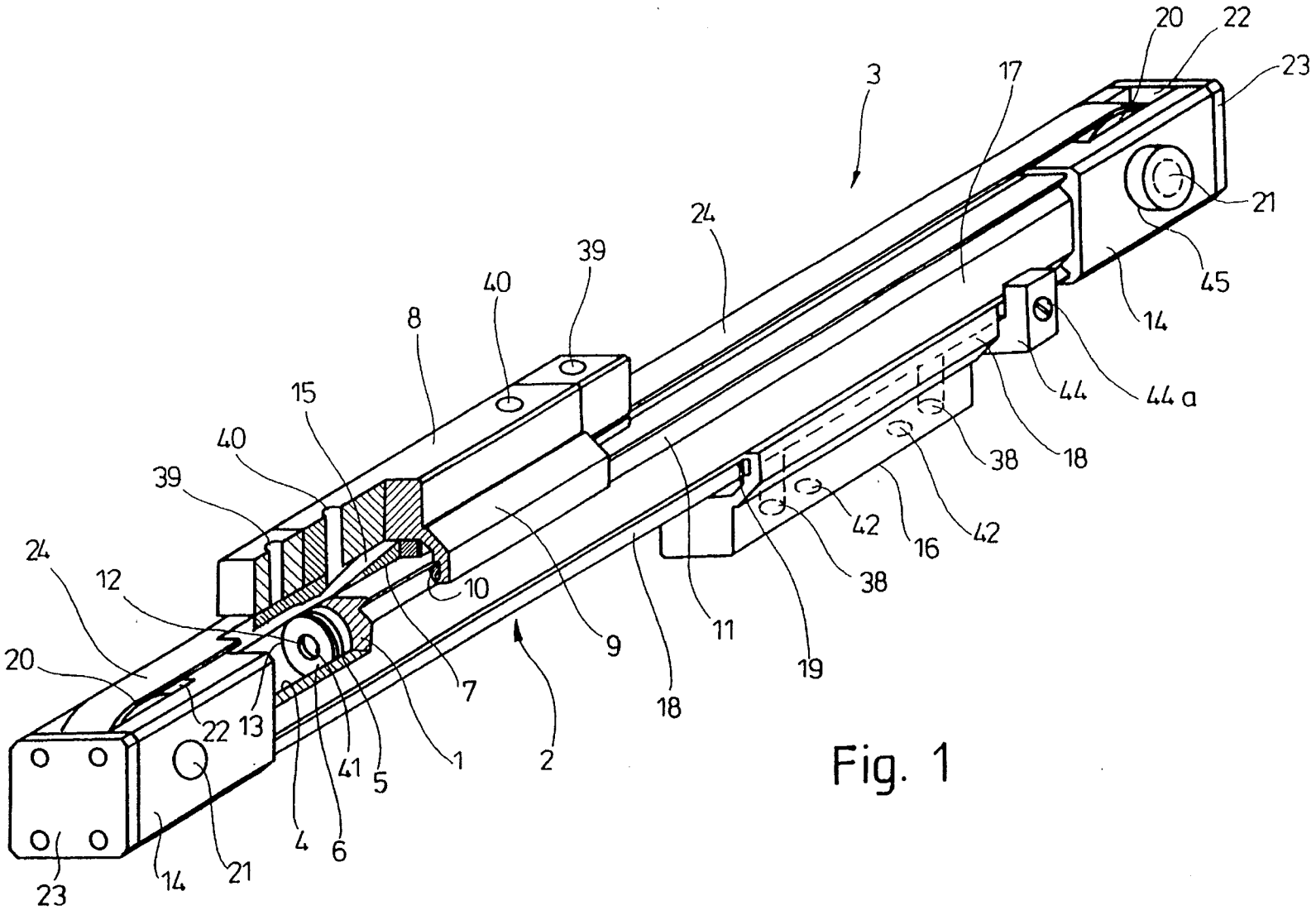
FIG. 1 is a partly sectioned, schematic perspective view of one actuator constructed in accordance with the invention.

Referring first to FIG. 1, the actuator includes an elongate profiled tube 1 which constitutes the cylinder body 2 of a so-called rodless cylinder 3. The cylinder 3 is in this case a pneumatic cylinder but it could alternatively be a hydraulic cylinder.

The profiled tube 1 is a, light, eg aluminium, metal extrusion cut to length. Externally, it is substantially square in cross-section and internally it is formed with a cylindrical bore 4. The upper wall of the tube 1 is longitudinally slotted at 5. A sealed piston 6 is reciprocably movable in the cylindrical bore 4 and has connected to it a force transmitting element 7 that projects through the slot 5 and is connected to a first, sliding element in the form of a yoke 8.

The yoke 8 laterally spans the slot 5 and has on each side a skirt 9 on the interior of which a bearing surface in the form of an elongate prismatic guide rail 10 is mounted. The guide rails 10 are accommodated in respective V-shaped bearing grooves 11 formed in the external surface of the profiled tube 1. As can be seen, the grooves 11 are located laterally of the longitudinal slot 5 above the horizontal symmetry plane 13 of the profiled tube 1 that passes more or less through the main axis 12 of piston 6.

Two end caps 14 are sealingly secured to the respective ends of the profiled tube 1 and form together with the profiled tube 1 two cylinder chambers on either side of the piston 6. The end caps 14 contain ports (not shown) for compressed air which communicate with their respective cylinder chambers. The two cylinder chambers are sealed, in the region of the slot 5, by an elastic sealing band (not visible) and a cover band 15 that are both fixed at their ends in the end caps 14.

The construction so far described is that of a known rodless cylinder and for further details the reader is referred to the European patent specifications mentioned above.

In accordance with the invention, however, a second sliding element 16 is mounted on the profiled tube 1 on the opposite side thereof relative to the yoke 8. The second element 16 is similar in design to the yoke 8 and is likewise longitudinally movable along the profiled tube 1. For this purpose, the profiled tube 1 has additional V-shaped grooves 18 formed in its side walls 17 and these grooves 18 are parallel to the grooves 11.

As in the case of the yoke 8, the bearing element 16 has skirts 18 the interior of which are provided with prismatic guide rails 19 that engage in the grooves 18.

Each end cap houses in a cavity 22 formed therein a roller 20 that is mounted for free rotation on a horizontal axle 21. Each cavity 22 is closed at its free end by a cover 23 secured in place by bolts or screws.

Two bands 24 acting as flexible drive means pass around the rollers 20 and are connected at their ends to the yoke 8 and to the second element 16. The yoke 8 and element 16 are therefore coupled together by means of the bands 24 and the flexible drive means is therefore essentially endless. If, now, piston 6 is forced to move to and fro by supplying compressed air alternately to the two cylinder chambers, the yoke 8 and the element 16 will move linearly along the profiled tube 1 at the same speed but in opposite directions. Grippers, further actuators etc may be mounted on the yoke 8 and/or on the element 16 and will move accordingly.

Figure 2:
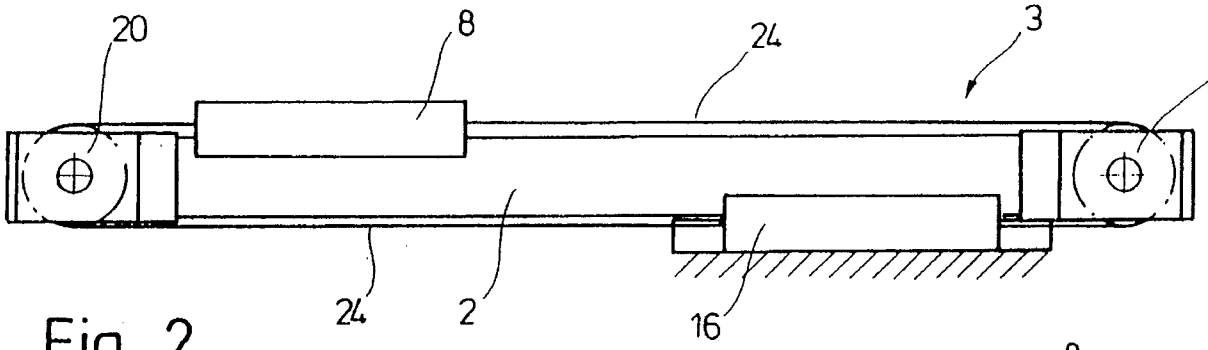
FIGS. 2 to 4 show, in side elevation, the actuator of FIG. 1 in three different positions during its operation.

If appropriate, the actuator described above may be fixedly mounted on a stationary structure by means of, for example, bolts that engage in female threads (not shown) formed in the end caps 14. However, and with reference to FIGS. 2 to 4, in other applications the actuator may be fixedly mounted on a stationary surface 25 via the second element 16. If, now, the two cylinder chambers in the profiled tube 1 are alternately pressurized, the whole rodless cylinder 3 will move to and fro relative to the stationary element 16. In other words, the element 16 will act as a mount and bearing for the rodless cylinder 3. At the same time, the yoke 8 will move relative to the profiled tube 1 in the same direction as movement of the tube itself. In fact, the yoke 8 will move at double the speed of the tube 1 relative to the stationary second element 16. Also in this arrangement, the stroke of the yoke 8 is double that of the profiled tube 1 as is shown in the schematic presentation of three positions of the movement in FIGS. 2 to 4. FIG. 2 and FIG. 4 show the position of the yoke 8 and the profiled tube 1 at, respectively, the left and right limits of the movement whereas FIG. 3 shows the mid-position of the movement.

Figure 3:
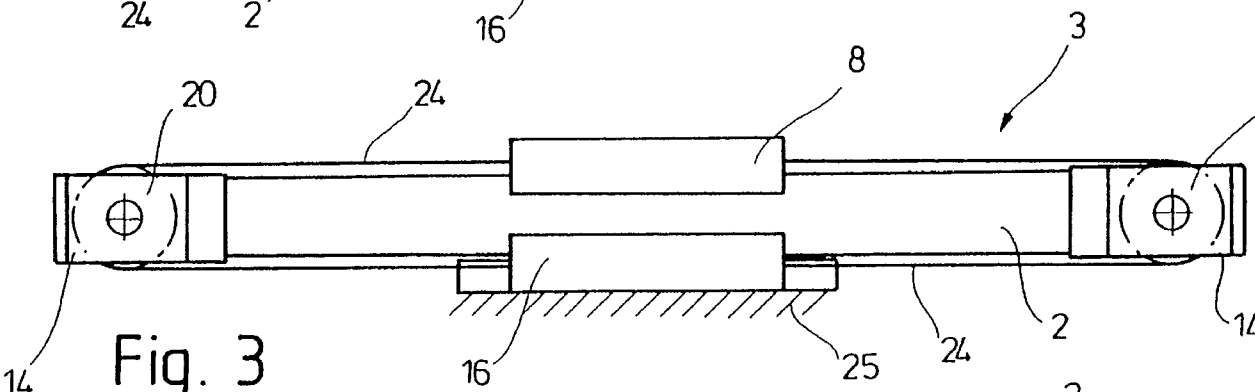
Figure 4:
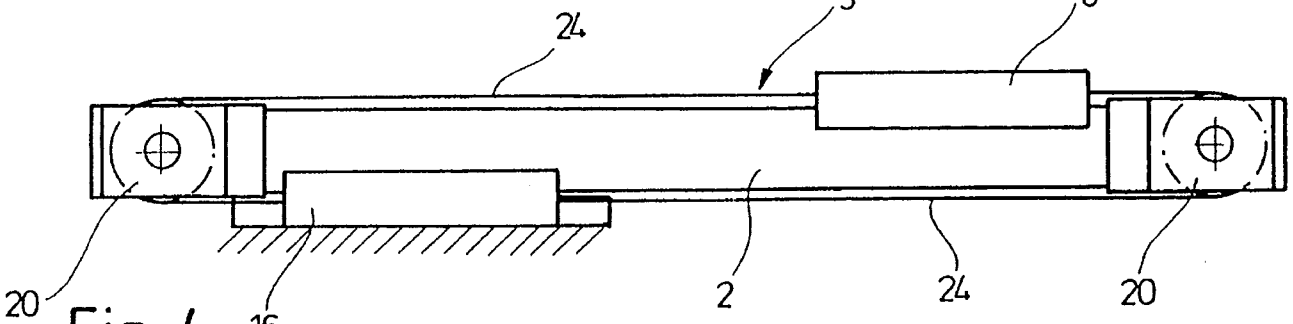
Figures 5, 6:
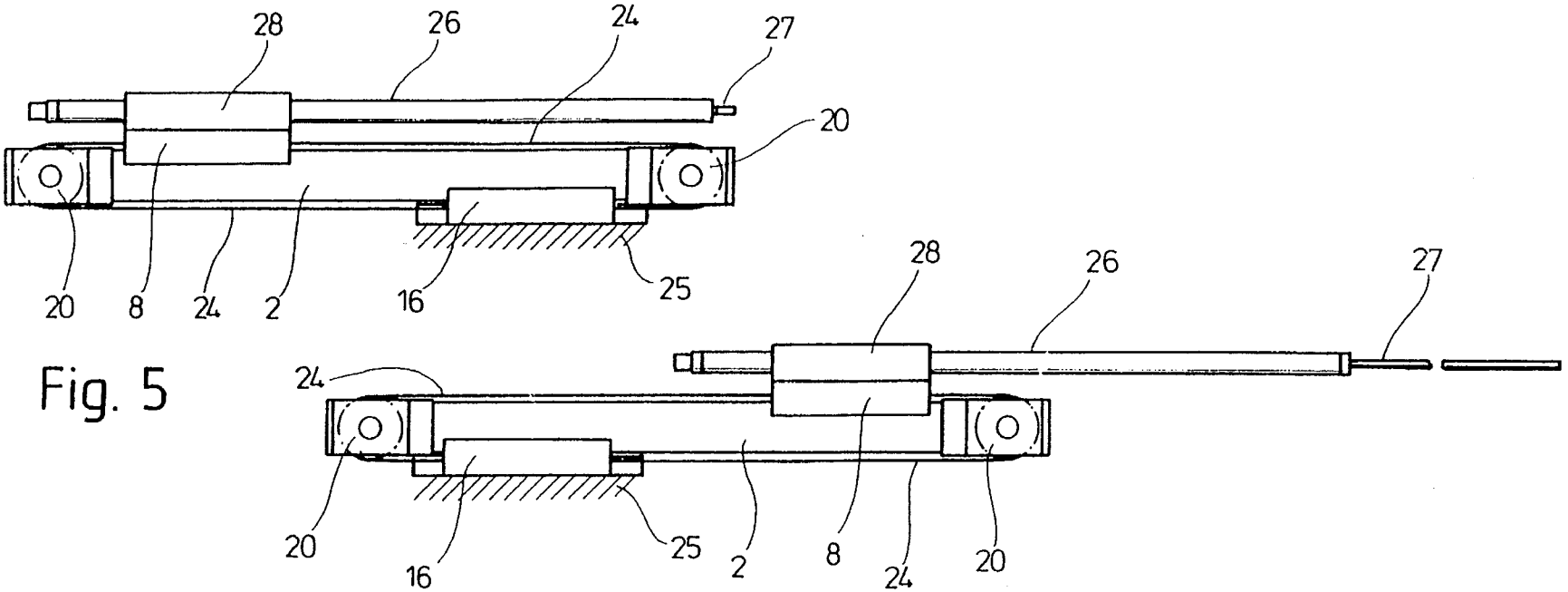
FIGS. 5 and 6 show, in side elevation, the actuator according to FIG. 1, in one modified form, at two different positions during its operation.

FIGS. 5 and 6 show a similar arrangement to FIGS. 2 to 4, but wherein a conventional rodded pneumatic cylinder 26 is fixedly mounted on the yoke 8. The pneumatic cylinder 26 is mounted on the yoke 8 so that its piston rod 27 extends longitudinally of the profiled tube 2. The pneumatic cylinder 26 is located in a mounting block 28 which is fixed to the yoke 8 and that contains the necessary pneumatic connections and, optionally, pneumatic valves for controlling the pneumatic cylinder 26.

Comparing FIGS. 5 and 6, it can be seen that the pneumatic cylinder 26 provides an additional stroke of the actuator. FIG. 5 shows that it is possible for the overall length of the actuator, when the yoke 8 is in its far left position and the cylinder 26 is at the end of its instroke, to be about the same as the length of the rodless cylinder 3. However, FIG. 6 shows the yoke 8 in its far right position with the piston rod 27 fully extended, thus achieving the maximum stroke of the actuator.

Figures 7, 8, 9:
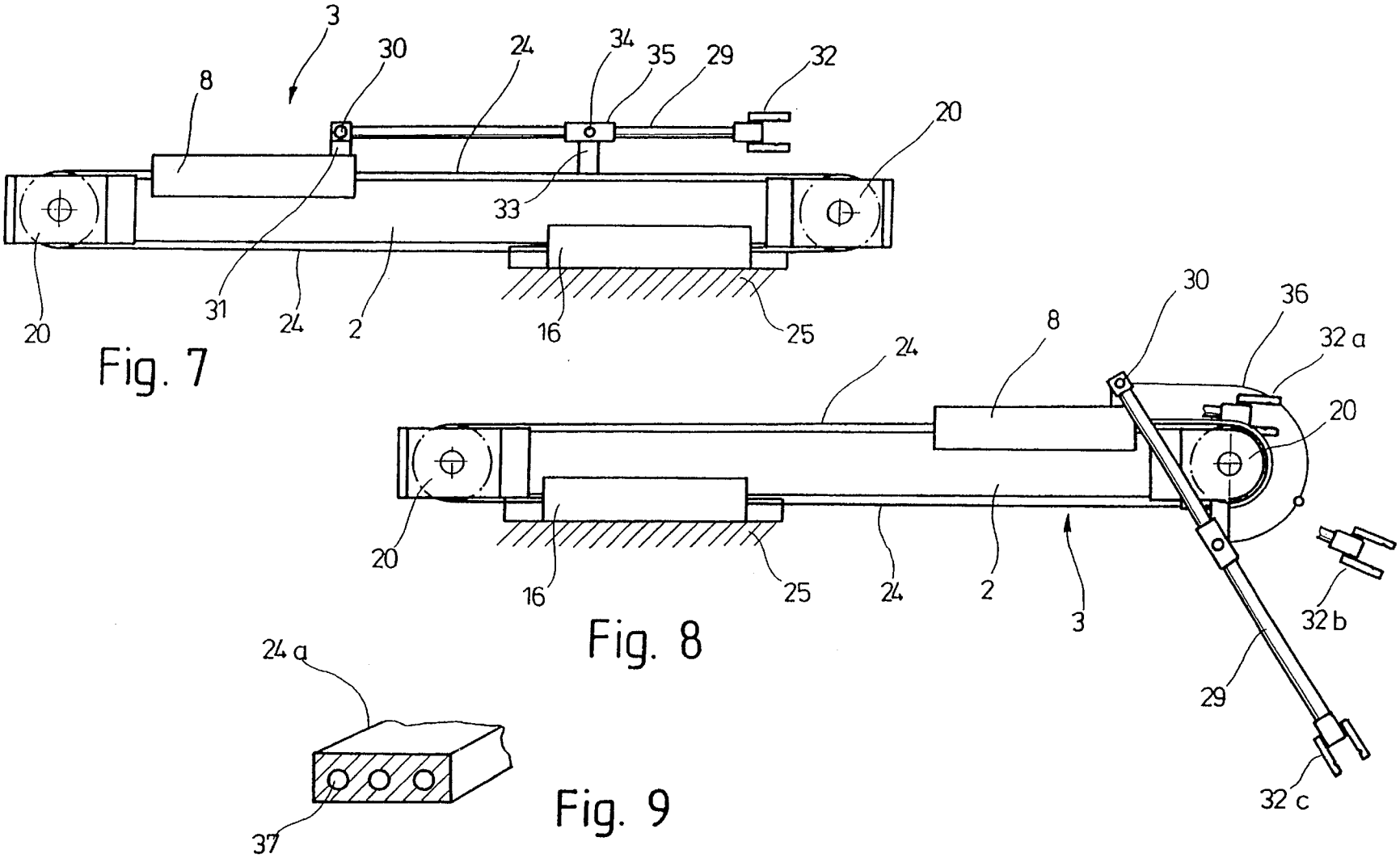
FIGS. 7 and 8 show, in side elevation, the actuator according to FIG. 1, in another modified form, at two different positions during its operation.
FIG. 9 is a perspective cross-section of the flexible drive means suitable for use in the actuators shown in FIGS. 1 to 8.

FIGS. 7 and 8 shows another arrangement similar to that of FIGS. 2 to 4 but wherein a rod 29 is pivotally mounted, in laterally off-set fashion, on the yoke 8.

The rod 29 is pivotally mounted on a support 31, located at one end of the yoke 8, by means of a pin 30. The other end of rod 29 carries, for example, a gripper 32. A support 33 for the rod 29 is mounted on the flexible band 24 in laterally off-set fashion and, as can be seen in FIG. 7, will maintain the rod 29 parallel to the band during most of the stroke of the actuator. The support 33 is pivotally connected by a pin 34 to a bush 35 mounted on the rod 29.

When the actuator is in its far left position, as shown in FIG. 7, the rod 29 is parallel to the profiled tube 1 and within the confines of the length of the actuator. However, if now, starting from the position shown in FIG. 7, the left hand chamber of the rodless cylinder 3 is pressurised, the rodless cylinder moves to the right relative to the stationary element 16 and the yoke 8 moves to the right relative to the profiled tube 1. At the same time, the support 33 approaches, and eventually reaches, the right hand roller 20 where the band 24 turns through 180° and, as a consequence, the pin 34 will perform a curved locus 36 (see FIG. 8) and the rod 29 will tilt, as can be seen in FIG. 8. The gripper 32 therefore moves linearly from the position shown if FIG. 7 and then sequentially through positions 32*a*, 32*b* and 32*c* shown in FIG. 8. The gripper 32 thus executes a combined linear and lateral movement which can, for example, be used to pick up a part and then transport it by pressuring the right hand chamber of the rodless cylinder 3 whereby the above movements are carried out in reverse.

The rod 29 could of course be replaced by a pneumatic cylinder such as 26, with a gripper 32 being mounted on the piston rod 27, or by any other device. The compressed air for the pneumatic cylinder 26, or other energy source, can be supplied via the bands 24, as will now be described.

FIG. 9 shows a sectional perspective view of part of a band 24*a* comprising a flexible plastics or rubber material which may be reinforced with, say, textile fibres. Within its thickness, and along the whole of its length there are three conduits 37. These longitudinal conduits 37 are sealingly connected with ports 38 formed in the second element 16, as indicated in FIG. 1, and also with ports 39 in the yoke 8. In the embodiment shown in FIGS. 5 and 6, appropriate connecting channels in the mounting block 28 for the pneumatic cylinder 26 are linked to the ports 39.

It is of course possible to supply other media, e.g. cooling liquid, from a stationary source to a device located on the yoke 8 via the longitudinal channels 37 and in the same way it is possible to supply electrical power through conductors housed in the channels 37 to a device mounted on the yoke 8. Alternatively, it would be possible for that purpose to use suitable flexible means such as flexible electrical leads, tubes or other means located on the upper side of the bands 24 e.g. formed integrally therewith, or adhered thereto. Especially in cases where the second element 16 is stationary (as in FIGS. 2 to 8), it can be advantageous to supply compressed air to the rodless cylinder 3 via the element 16.

The yoke 8 and the element 16 are generally equivalent to one another and therefore their functions are interchangeable. Thus, for example, the yoke 8 could be fixedly mounted on, say, the mounting surface 25 shown in FIGS. 2 to 8 with the second element 16 carrying the load. In such an arrangement, it is advantageous to supply compressed air to the rodless cylinder 3 via the stationary yoke 8. For that purpose, two connecting channels 40 are formed in the yoke 8 to supply alternately the cylinder chambers on each side of the piston 6 with compressed air. The channels 40 extend through the force-transmitting element 7 into the respective chambers via ports 41 formed in the opposed ends of the piston 6.

The fixed mounting of the element 16 to the mounting surface 25 (see FIGS. 2 to 8) can be effected by, for example, bolts that engage with threaded holes 42 formed in the element. The yoke 8 may, for the same reason, be formed with threaded holes to enable it to be fixed by mounting it to a structure as just described. In addition, it may be appropriate to equip the actuator with a stroke limiter. This can be done in a simple way by mounting a stroke limiting bracket 44 onto the profiled tube 1, the bracket preferably being located in the lateral grooves 18 and having means, for example a screw 44*a*, to secure it in the desired position.

Finally it is possible to provide a brake on at least one of the rollers 20, the yoke 8 or element 16 or on the profiled tube 1. As an example, and with reference to FIG. 1, a brake 45 is mounted on the right hand end cap 14 and acts on the axle 21 on which the roller 20 is mounted. The brake 45 can be adjusted if necessary.

As will be appreciated from, in particular, the specific embodiments described above, the present invention provides a relatively compact and simple actuator that may be adapted to perform a number of different functions in the context of, especially, material and component handling operations.

I claim:

1. A fluid-powered linear actuator comprising:

a) a fluid-powered rodless cylinder including an elongate body and a piston reciprocably movable within a bore in said body upon the application of fluid pressure alternately to opposite ends of the piston;

b) a first element mounted externally of the body on or adjacent to one side thereof and reciprocably drivable by, and in the same direction as, the piston longitudinally of the body;

c) a second element mounted externally of the body on or adjacent to a side thereof opposite to said first side and reciprocably movable longitudinally of the body; and d) flexible drive means connected to the first element or the piston and to the second element, the flexible drive means extending longitudinally of the body and around bearing means located at opposite ends of the body, whereby movement of the piston in response to the application of fluid pressure thereto causes the second element simultaneously to move longitudinally of the body in a direction opposite to the direction of movement of the piston and the first element.

2. An actuator according to claim 1 wherein the rodless cylinder is of the longitudinally slotted body type, the first element being connected directly to the piston by coupling means extending through the slot.

3. An actuator according to claim 1 wherein the first and second elements partially surround the cylinder body and have bearing surfaces that substantially engage bearing surfaces formed externally of the cylinder body.

4. An actuator according to claim 3 wherein the bearing surfaces formed externally of the cylinder body comprise longitudinal channels or projections formed in or on the cylinder body.

5. An actuator according to claim 3 wherein the first element laterally bridges the slot and has bearing surfaces that engage bearing surfaces formed externally of the body between the plane of the slot and a parallel plane passing through the axis of the piston.

6. An actuator according to claim 1 wherein one of said elements has means for fixedly securing it to a structure whereby, in use, movement of the piston upon the application of fluid pressure thereto will cause the cylinder body simultaneously to move linearly relative to said one element and said structure in the same direction as the direction of movement of the piston and the other element.

7. An actuator according to claim 6 wherein said one element is provided with actuating fluid supply ports that communicate with the bore in the cylinder body on each side of the piston.

8. An actuator according to claim 1 wherein the flexible driving means comprises belt means.

9. An actuator according to claim 8 wherein the bearing means for the belt means each comprises a roller.

10. An actuator according to claim 6 wherein said other element is adapted to have a further actuator mounted upon it.

11. An actuator according to claim 10 wherein said further actuator is a fluid-powered actuator and wherein interconnected passageways are formed in said first element, in the flexible drive means and in the second element for the flow of actuating fluid to the further actuator.

12. An actuator according to claim 1 further including brake means to brake its motion.

13. An actuator according to claim 12 wherein said brake means acts on or through said bearing means about which the flexible drive means passes.

14. An actuator according to claim 1 further including stroke-limiting means.

15. An actuator according to claim 14 wherein said stroke-limiting means is adjustably secured externally to the body of the actuator and serves as an abutment for one of said elements.

* * * * *